US005546886A

United States Patent [19]

Franceschelli et al.

[11] Patent Number: 5,546,886

[45] Date of Patent: Aug. 20, 1996

[54] CRAFT WITH RIGID TUBULARS, HAVING WATERTIGHT, NON-COMMUNICATING COMPARTMENTS

[76] Inventors: Luciano Franceschelli, via Nogaredo, 49, 00124 Roma; Angelo Mancini, via dei Manicai, 41, 00054 Fiumicino RM, both of Italy

[21] Appl. No.: 356,261

[22] PCT Filed: Jul. 20, 1993

[86] PCT No.: PCT/IT93/00077

§ 371 Date: Dec. 15, 1994

§ 102(e) Date: Dec. 15, 1994

[87] PCT Pub. No.: WO94/26584

PCT Pub. Date: Nov. 24, 1994

[30] Foreign Application Priority Data

May 18, 1993 [IT] Italy ..... RM93A0326

[51] Int. Cl.[6] ..... B63B 43/10

[52] U.S. Cl. ..... 114/360; 114/68; 114/343; 114/363

[58] Field of Search ..... 114/360, 68, 69, 114/343, 345, 363, 65 A

[56] References Cited

U.S. PATENT DOCUMENTS

| | | | |
|---|---|---|---|
| 2,950,701 | 8/1960 | De Stefani | 114/61 |
| 3,052,202 | 9/1962 | Dearborn | 114/61 |
| 3,436,774 | 8/1969 | Schmitz . | |
| 5,143,013 | 1/1992 | Huebner . | |

FOREIGN PATENT DOCUMENTS

| | | |
|---|---|---|
| 2287377 | 5/1976 | France . |
| 2578220 | 9/1986 | France . |
| 2332529 | 1/1975 | Germany . |
| 8808091 | 8/1988 | Germany . |
| 1366821 | 9/1974 | United Kingdom . |

*Primary Examiner*—Sherman Basinger
*Attorney, Agent, or Firm*—Beveridge, DeGrandi, Weilacher & Young, L.L.P.

[57] ABSTRACT

A water craft includes a rigid tubular hull structure corresponding to the structure of inflatable tubulars of known rubber dinghies. Preferably, the hull is made of polyester reinforced with glass fiber, plastic or metal. The external shape of the tubular hulls is cylindrical or other similar shape, and in the internal part, the tubular hulls are provided with a structure that considerably increases the internal space of the hulls, while maintaining the typical shape of rubber dinghies. Lateral seat backs may be provided on hinges on the upper external edge of the craft, and built-in seats are provided on the upper, external surface of the craft.

23 Claims, 3 Drawing Sheets

CRAFT WITH RIGID TUBULARS, HAVING WATERTIGHT, NON-COMMUNICATING COMPARTMENTS

BACKGROUND OF THE INVENTION

The present invention concerns a craft with rigid tubulars, having watertight, non-communicating compartments, and a high hydrodynamic efficiency, wherein internal spaces are enlarged with respect to the known rubber dinghies.

Rubber dinghies, beyond their great advantages of maneuverability and transportability, also have a few disadvantages:

- they are subject to puncturing, which comprises their most serious damage;
- they require a rather long time for inflating;
- during movement and in particular situations, they may get deformed in an impact with waves, with a consequent increase of the friction and loss of speed and seaworthiness; and
- due to the cylindrical structure of their edges and to the material they are constructed of, seats or similar structures are not provided.

SUMMARY OF THE INVENTION

It is the aim of the present invention to provide a craft that maintains the positive features of a rubber dinghy without its disadvantages.

The aim set forth is reached by means of the craft according to the present invention, which includes a structure corresponding to one of the inflatable tubulars of rubber dinghies, constructed with different kinds of rigid materials, like polyester reinforced with glass fiber, having externally a cylindrical shape or a similar shape, and internally being provided with cavities that increase the internal space so that, while maintaining the shape typical for rubber dinghies, the object according to the present invention has a structural stiffness and a mechanical resistance.

Still according to the present invention, it is provided that the craft be provided on deck with infrastructures for providing cabins and/or protection from atmospheric agents; to this purpose, a greater space inside the craft offers great advantages.

The advantages of the craft according to the present invention consist of a greater internal space, the lack of maintenance, resistance to aging and puncturing, reduced petrol consumption as compared with rubber dinghies, and greater safety on sea with respect to all conventional crafts.

BRIEF DESCRIPTION OF THE DRAWINGS

The present invention will be described in more detail hereinbelow relating to the enclosed drawings in which some preferred embodiments are shown.

DETAILED DESCRIPTION OF THE INVENTION

Figure 1:
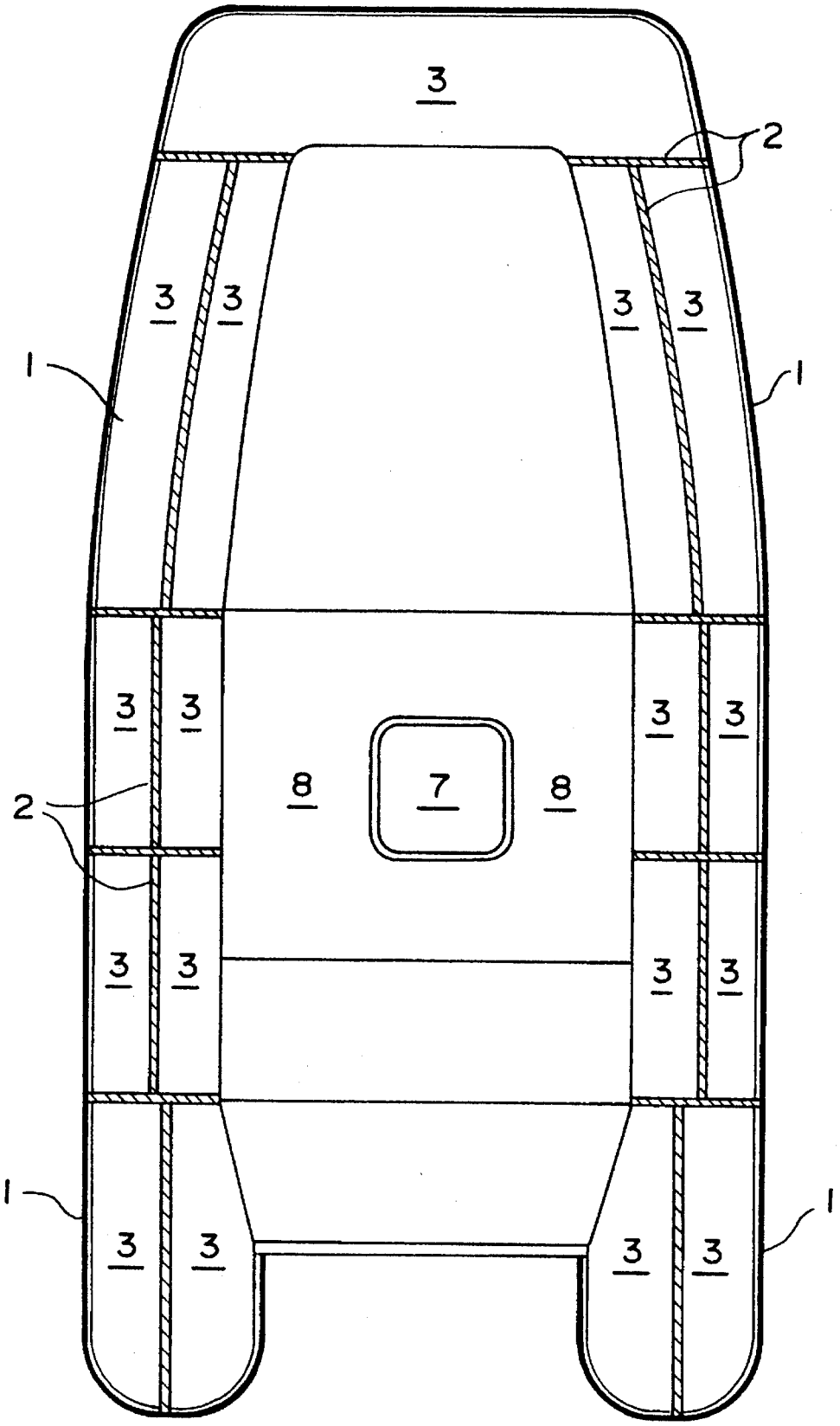
FIG. 1 shows a plant scheme of the craft according to the present invention, with rigid tubulars, having watertight, non-communicating compartments, provided for the lower hull as well as for the deck.

The enclosed figures show a craft with rigid tubulars, having watertight, non-communicating compartments, a high hydrodynamic efficiency and enlarged internal spaces. The craft includes:

- tubular hulls 1 made out of a rigid material like metal, plastic or polyester reinforced with glass fiber, provided with a floating capacity similar to inflatable crafts, but being rigid and not deformable during movement;
- a plurality of diaphragms 2 for creating longitudinal and transverse compartments in the internal volume of hulls 1, dividing the craft into watertight, non-communicating chambers 3 for anti-sinking safety;
- internal perimetral shapes 4 of tubulars 1, more or less re-entrant, for a greater internal space and for maintaining anti-sinking volume reserves;
- a plurality of lateral backs 5, movable on hinges 6, which may be applied onto the upper edges of the rigid tubulars 1.

Figure 7:
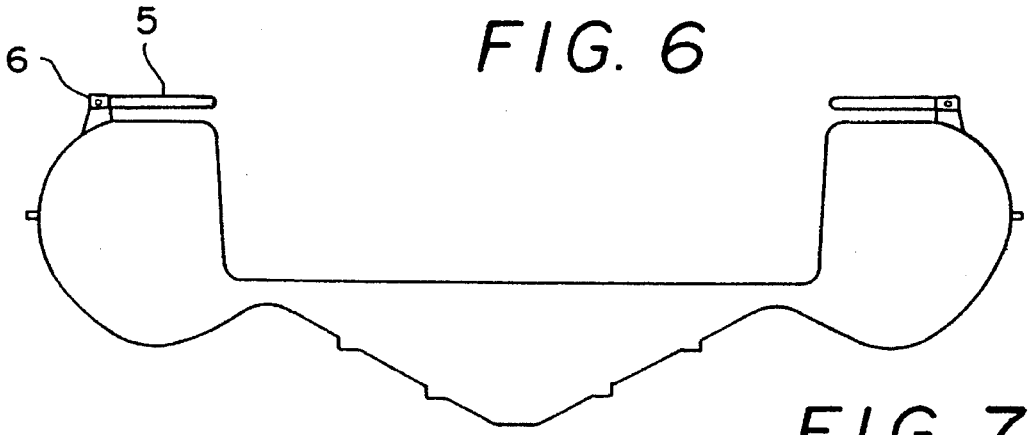

The lateral backs 5 may fold over the seat portion, as shown in FIG. 7, to thereby conceal the seat.

FIG. 1 is an overhead view of the craft. A plurality of longitudinally extending diaphragms 2 and a plurality of transversely extending diaphragms 2 are provided for separating an internal volume of each of the hulls 1 into longitudinal and transverse compartments, to thereby provide a plurality of non-communicating, watertight chambers 3 within each of the hulls 1 for anti-sinking safety. The longitudinally extending diaphragms 2 include a first diaphragm which diverges with respect to a centerline of the craft from a forward end toward a rearward end of the craft, as shown in FIG. 1. A second diaphragm extends rearwardly of the first diaphragm, and a third diaphragm extends rearwardly of the second diaphragm. The first, second and third diaphragms are longitudinally non-aligned, as illustrated in FIG. 1. FIG. 1 further shows a fourth diaphragm extending rearwardly of the third diaphragm.

In a possible structural variant shown in FIGS. 2, 3, 4A and 4B, the craft is realized by coupling the hull F and the deck C, and provides the presence of a series of separated watertight chambers, much closer in the lower part, i.e., in the hull F, than in the upper part, i.e., in the deck C. This increases the unsinkability, should the craft dash against a rock.

Still for the same purpose, the internal structure of the hull F, and therefore of tubulars 1, may be filled up with foam materials with closed cells.

Figure 2:
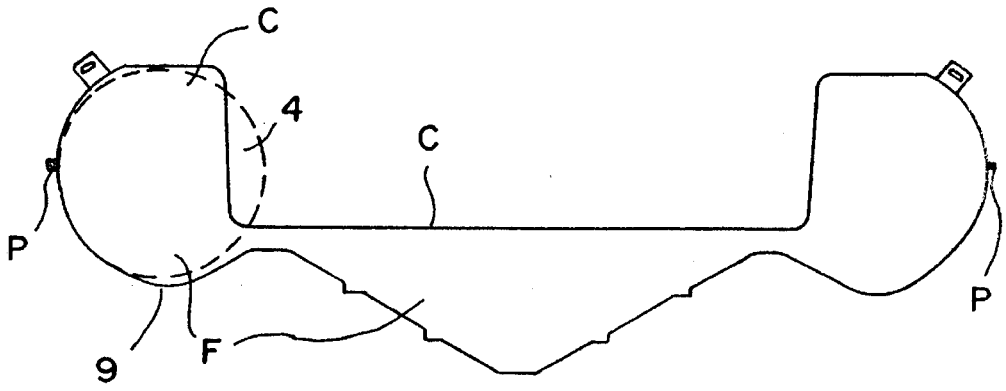
FIGS. 2, 3, 4A and 4B respectively show a square section, a lateral view and details of a craft obtained by coupling a hull F and a deck C, consisting of watertight chambers separated in a transversal and a longitudinal sense.
Figure 3:
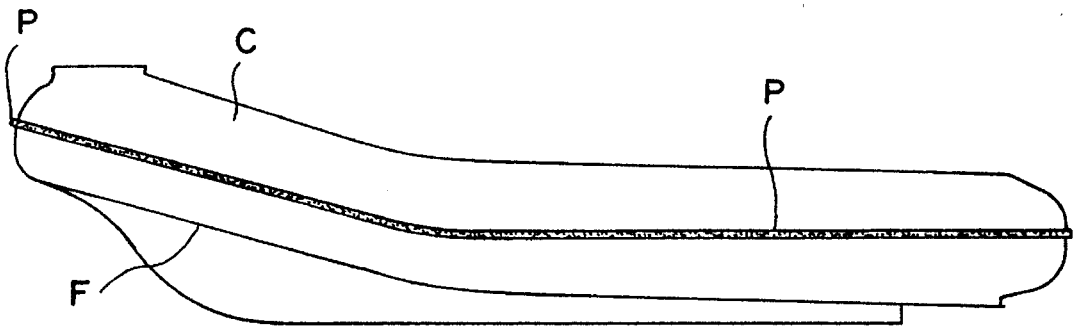
Figure 4A:
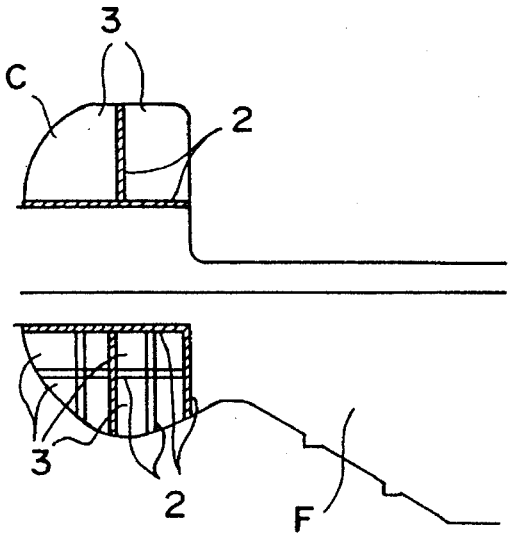
Figure 4B:
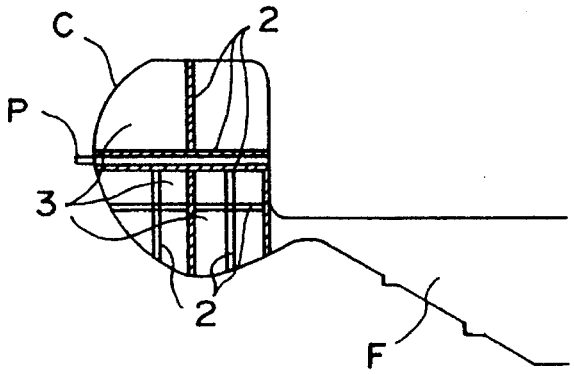
Figure 5A:
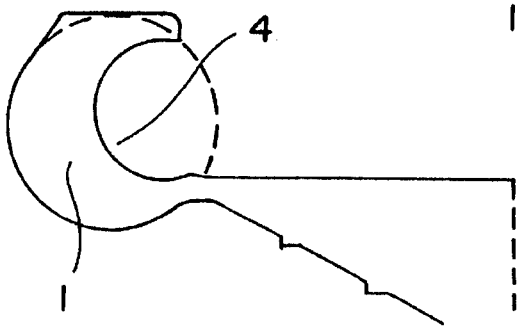
FIGS. 5A and 5B show a lateral scheme of a structure of a possible enlargement shape of the internal space, and of a structure variant of the tubulars.
Figure 5B:
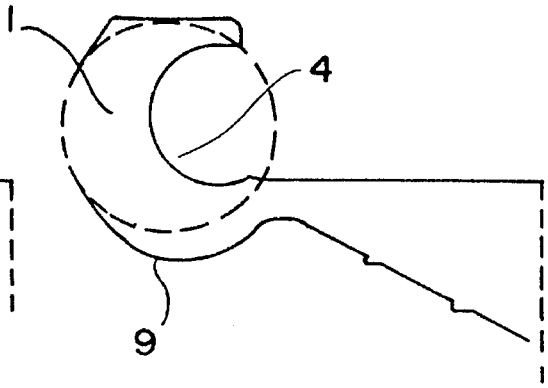
Figure 6:
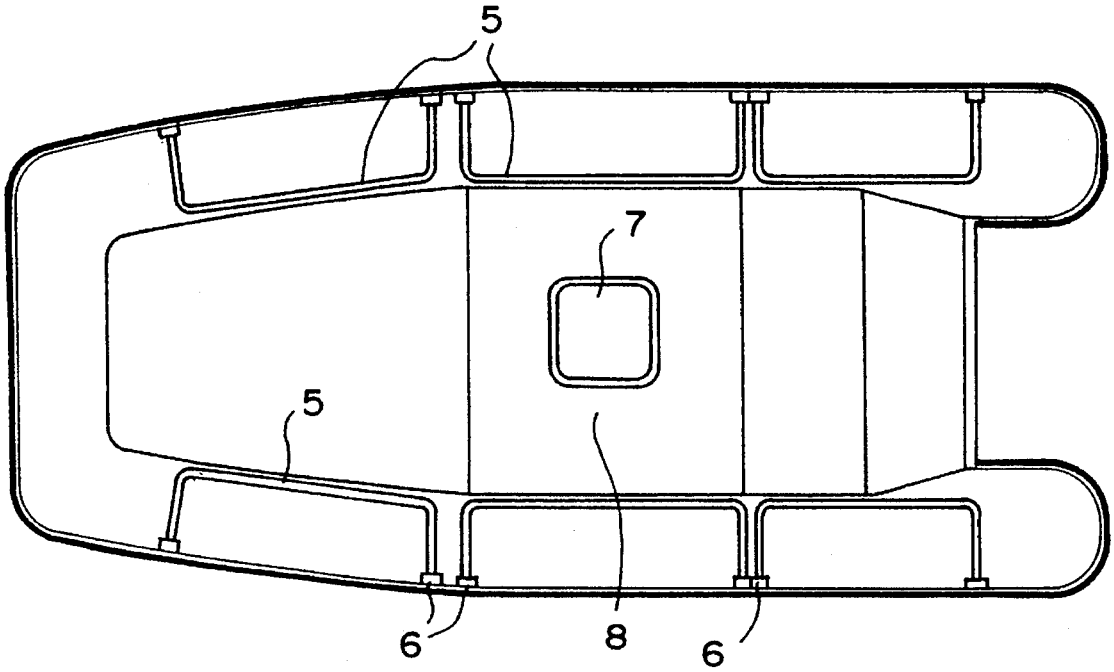
FIGS. 6 and 7 show an upper and a square scheme of a craft provided with lateral folding-backs. In possible variants, the seats may also be built into the structure of the upper external surface of the craft.

As a result of the greater internal space in a craft according to the present invention, the driving console 7 may be placed in a central position, as shown in FIGS. 1 and 6, with lateral areas 8 for walking. In previous crafts with very small dimensions, until now, the console was placed laterally for lack of space. Obviously, the shape of the tubulars 1 may also be different than cylindrical, as shown in FIGS. 2 and 5, where a further variant is shown provided with a keel-structure 9.

We claim:

1. A craft, comprising:

rigid tubular hulls which provide a floating capacity and are not deformable during movement of the craft;

a plurality of longitudinally extending diaphragms and a plurality of transversely extending diaphragms for separating an internal volume of each of the hulls into longitudinal and transverse compartments, to thereby provide a plurality of non-communicating, watertight chambers within each of the hulls for anti-sinking safety, wherein said longitudinally extending diaphragms include a first diaphragm diverging with respect to a centerline of said craft from a forward end toward a rearward end, a second diaphragm extending rearwardly of said first diaphragm, a third diaphragm extending rearwardly of said second diaphragm, and wherein said first, second and third diaphragms are longitudinally non-aligned;

perimetral internal shapes in the tubular hulls for increasing the internal volume of the tubular hulls; and a plurality of lateral backs, movable on hinges, applied onto upper, external edges of the craft.

2. A craft according to claim 1, further including a rigid deck coupled to the rigid hulls, wherein the deck includes a plurality of diaphragms which separate the deck into a plurality of watertight chambers.

3. A craft according to claim 2, wherein the watertight chambers are closer in the hulls than in the deck, thereby increasing the unsinkability of the craft, should the craft dash against a rock.

4. A craft according to claim 1, further including a deck coupled to the rigid hulls, wherein watertight chambers are provided in the deck, and the watertight chambers in the deck and in the hull are provided in a series of separate, watertight chambers, wherein the watertight chambers are closer together in the hulls than in the deck, thereby increasing the unsinkability of the craft, should the craft dash against a rock.

5. A craft according to claim 1, wherein the tubular hulls are filled up with closed-cell foams.

6. A craft according to claim 1, further including a driving console located in a central position of the craft, wherein lateral areas for walking are provided at each lateral side of the console.

7. A craft according to claim 1, wherein the tubular hulls are provided with a lower keel-structure.

8. A craft according to claim 1, wherein built-in seats are provided in an upper external surface of the craft at the location of the lateral backs.

9. A craft according to claim 7, wherein the lateral backs fold down over the seats via the hinges, thereby concealing the seats.

10. A craft according to claim 1, wherein the rigid hulls are constructed from a material selected from the group consisting of metal, plastic, and polyester reinforced with glass fiber.

11. A craft, comprising:

a rigid tubular hull which provides a floating capacity and is not deformable during movement of the craft;

a plurality of longitudinally extending diaphragms and a plurality of transversely extending diaphragms for separating an internal volume of the hull into longitudinal and transverse compartments, to thereby define a plurality of non-communicating, watertight chambers within the hull for anti-sinking safety, wherein said longitudinally extending diaphragms include a first diaphragm diverging with respect to a centerline of said craft from a forward end toward a rearward end, a second diaphragm extending rearwardly of said first diaphragm, a third diaphragm extending rearwardly of said second diaphragm, and wherein said first, second and third diaphragms are longitudinally non-aligned; and a driving console provided in the craft.

12. A craft according to claim 11, further including a deck coupled to the rigid hull, wherein the deck includes a plurality of diaphragms for separating an internal volume of the deck into longitudinal and transverse compartments to define a plurality of non-communicating watertight chambers in the deck.

13. A craft according to claim 12, wherein the watertight chambers are closer together in the hull than in the deck, thereby increasing the unsinkability of the craft.

14. A craft according to claim 11, wherein the internal volume of the tubular hull contains closed-cell foam.

15. A craft according to claim 11, wherein the driving console is located in a central position of the craft.

16. A craft according to claim 15, wherein open lateral areas are provided at each lateral side of the console.

17. A craft according to claim 11, wherein the tubular hull is provided with a lower keel-structure.

18. A craft according to claim 11, further including a lateral back applied onto an upper, external edge of the craft.

19. A craft according to claim 18, further including a built-in seat provided in an upper external surface of the craft at a location of the lateral back.

20. A craft according to claim 19, wherein the lateral back folds down over the seat, thereby concealing the seat.

21. A craft according to claim 20, wherein the lateral back folds down over the seat by a hinge.

22. A craft according to claim 11, wherein the rigid hull is constructed from a material selected from the group consisting of metal, plastic, and polyester reinforced with glass fiber.

23. A craft according to claim 11, further including a perimetral internal shape provided in the tubular hull for increasing the internal volume of the hull.

* * * * *